US006354401B2

(12) United States Patent
Murray

(10) Patent No.: US 6,354,401 B2
(45) Date of Patent: Mar. 12, 2002

(54) GUTTER SAVER AND LADDER SUPPORT

(76) Inventor: John T. Murray, 1168 South St., Bridgewater, MA (US) 02324

( * ) Notice: Subject to any disclaimer, the term of this patent is extended or adjusted under 35 U.S.C. 154(b) by 0 days.

(21) Appl. No.: 09/746,906

(22) Filed: Dec. 22, 2000

Related U.S. Application Data

(60) Provisional application No. 60/171,571, filed on Dec. 23, 1999.

(51) Int. Cl.[7] ..... E06C 7/06

(52) U.S. Cl. ..... 182/214; 182/107; 182/108; 182/229; 248/48.1

(58) Field of Search ..... 182/107, 108, 182/214, 229; 248/48.1, 48.2, 210; 52/11, 12

(56) References Cited

U.S. PATENT DOCUMENTS

| | | | | | |
|---|---|---|---|---|---|
| 4,159,045 | A | * | 6/1979 | Brooks | 182/214 |
| 4,359,138 | A | * | 11/1982 | Kummerlin et al. | 182/107 |
| 4,469,194 | A | * | 9/1984 | McBride | 182/107 |
| 4,580,661 | A | * | 4/1986 | Thomson, Jr. | 182/214 X |
| 4,924,971 | A | * | 5/1990 | Rice | 182/107 X |
| 5,279,389 | A | * | 1/1994 | Crockett | 182/214 X |
| 5,358,071 | A | * | 10/1994 | Stennett | 182/214 |
| 5,497,848 | A | | 3/1996 | Travis | |
| 5,509,500 | A | | 4/1996 | Delagera | |
| 5,515,941 | A | | 5/1996 | Palmer et al. | |
| 5,549,261 | A | | 8/1996 | Hardin | |
| 5,743,356 | A | | 4/1998 | Mitchell | |
| 5,775,465 | A | | 7/1998 | Vossier | |
| 5,899,296 | A | * | 5/1999 | Lantz | 182/214 |
| 5,966,875 | A | | 10/1999 | Kuhns | |
| 5,971,100 | A | | 10/1999 | DeLeon et al. | |
| 6,009,974 | A | | 1/2000 | Jones | |
| 6,021,865 | A | | 2/2000 | Thompson et al. | |
| 6,045,102 | A | | 4/2000 | Terenzoni | |
| 6,092,625 | A | | 7/2000 | Bedrosian | |

FOREIGN PATENT DOCUMENTS

| | | | | |
|---|---|---|---|---|
| GB | 2253002 A | * | 8/1992 | 182/214 X |
| WO | WO-97/37100 | * | 10/1997 | 182/214 X |

* cited by examiner

*Primary Examiner*—Bruce A. Lev
(74) *Attorney, Agent, or Firm*—John P. McGonagle

(57) ABSTRACT

A U-shaped channel member fitted horizontally over a gutter, with each protruding channel member engaging the fascia board to which the gutter is attached. Ladder legs rest against the channel member between brackets. A strap attached to the channel member is adapted to engage a ladder rung with the gutter, thereby holding the ladder in engagement with the channel member and further preventing the ladder from sliding laterally or diagonal movement.

9 Claims, 2 Drawing Sheets

GUTTER SAVER AND LADDER SUPPORT

This application claims benefit of Provisional Appln. No. 60/171,571 filed Dec. 23, 1999.

BACKGROUND OF THE INVENTION

This invention relates to gutter systems for houses, and more particularly to an apparatus for protecting a gutter while providing support for a ladder.

Numerous drain systems for roofs have been provided in the prior art that include gutters that catch rainwater from roofs and carry it to leaders extending to the ground. Most houses built in the United States today include gutters which are secured to the fascia board of a house structure, just below the roof line. These gutters are necessary to protect siding or paint on the house front, back and side structures from damage from rain, snow and the like by catching the rain, snow and the like and causing it to flow to down spouts and away from the house structures with minimal contact with the house structures.

The construction of gutters and the placement thereof against the fascia board of a structure is well known in the art. The gutters are generally made of a thin sheet of aluminum, vinyl, plastic or wood, which are light in weight. The presence of thin aluminum or plastic gutters along the fascia board of a structure is a source of difficulty when one needs to access the roof or upper portion of the structure. Usually, a ladder is placed and supported against the structure, and the worker or home owner climbs the ladder to access, for example, the roof. However, since the gutters must stick out beyond the lower roof line to be effective in trapping rain and the like, the ladder must be placed against the gutters. The thin gutters of modern construction cannot withstand much pressure before bending. When a ladder is placed against the front of a gutter it will tend to crush the gutter and slide along it. This often results in a structure's gutter having to be replaced, although the initial work task had nothing to do with the gutters. Regardless of the method used in attaching a gutter to a building, e.g., hangers, straps, spikes, ferrules, etc., the gutter is very susceptible to scratching, denting, and crushing from prolonged ladder contact or from a weight overload from a ladder.

One of the common attempts to avoid gutter problems is the use of double-pronged ladder stabilizers. One of the real limitations with ladder stabilizers is that they are not very strong. Ladder stabilizers also tend to become unsquare with the ladder until a ladder's upper portion inside edges crushes the gutter, roof edge and flashing. Ladder stabilizers are especially a problem for ladder staging. Since stabilizers are firmly secured to the ladder, they need to be adjusted frequently and mechanically in relationship to where they would rest on the building for proper ladder staging bracket and plank placement. Furthermore, the ladder cannot be set under the eave since the projection of eave and gutter is almost equal to the width of the staging plank, thus providing minimal work space and a dangerous environment for a staging worker. Fastening any material to the eaves to prevent gutter damage only causes the need for repairs of another kind.

SUMMARY OF THE INVENTION

The present invention provides an apparatus for protecting a gutter while at the same time providing support for a ladder placed against the gutter. The present invention supports the weight of ladders, ladder brackets, staging planks, material and men by diffusing weight around a gutter directly to the fascia.

The present invention accomplishes this by providing a U-shaped channel member fitted horizontally over the gutter, with each protruding channel member engaging the fascia board to which the gutter is attached. Ladder legs rest against the channel member between invention brackets. A strap attached to the channel member is adapted to engage a ladder rung with the gutter, thereby holding the ladder in engagement with the channel member and further preventing the ladder from sliding laterally or diagonal movement, i.e., ladder bottom kick out. The present invention also provides a means for speedy set up of ladder and staging.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
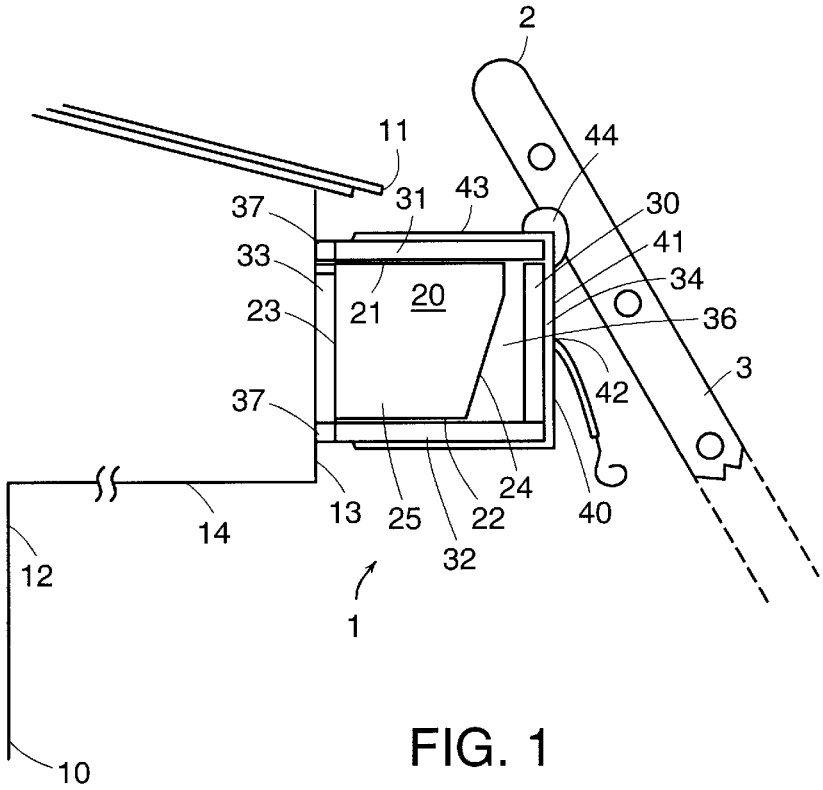
FIG. 1 is a side view of the invention.
Figure 2:
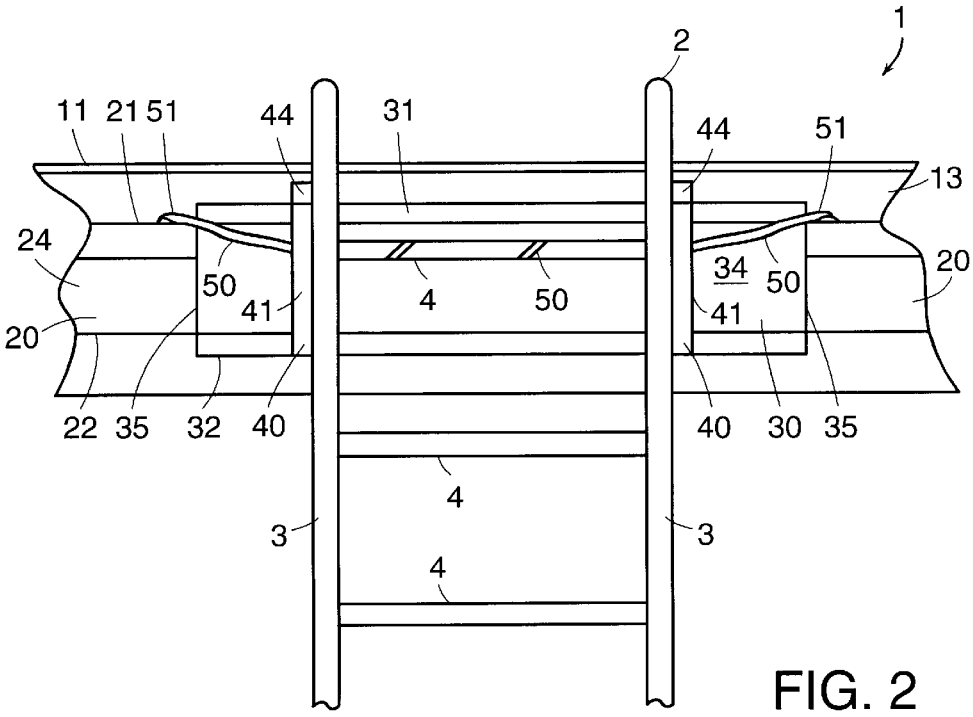
FIG. 2 is a front view of the invention.
Figure 3:
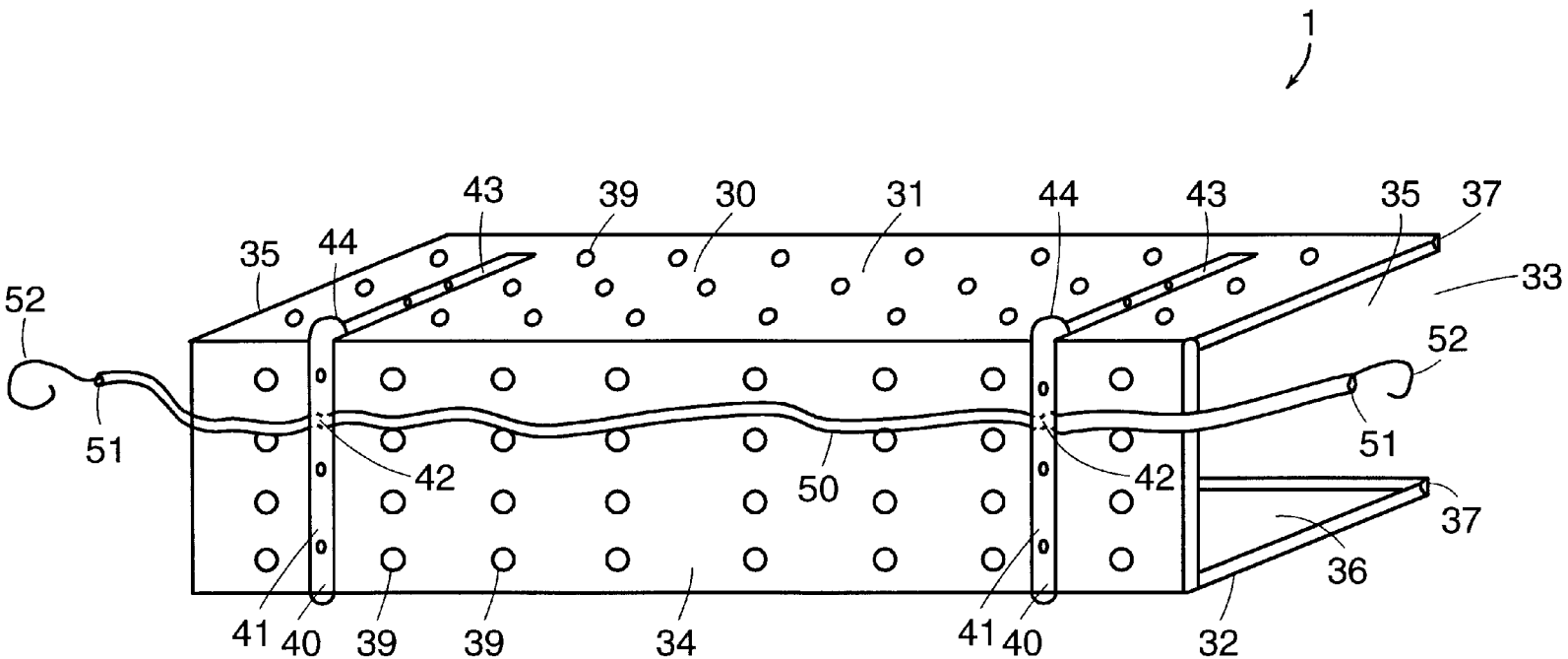
FIG. 3 is a front, perspective view of the invention.

Referring to the drawings in detail wherein like elements are indicated by like numerals, there is shown an external, vertical building wall structure 10, such as a front, rear or side wall, an eave 14, a fascia board 13, a lower roof line edge 11 extending over the fascia board 13, and a rain gutter 20 attached to the fascia board 13, said gutter 20 extending out beyond the lower roof line 11.

The rain gutter 20 has a top 21, a bottom 22, a rear 23, a front 24, and two sides 25. The gutter sides 25 define a longitudinal axis which lies in a horizontal plane. The rain gutter rear 23 abuts the fascia board 13 and may be connected by means of hangers, straps, or spikes and ferrules.

The present invention 1 provides a horizontal, U-shaped channel member 30 comprised of a flat top 31, a flat bottom 32, an open rear 33, a closed, flat front 34, and two open sides 35, said front 34 being connected to said top 31 and said bottom 32. The channel member sides 35 define a longitudinal axis which lies in a horizontal plane. In this embodiment of the invention 1, the channel member's top 31 and bottom 32 lie in planes perpendicular to the channel member's front 34. The channel member's front 34, top 31 and bottom 32 define a channel member interior 36. The top rear 31, 33 and bottom rear 32, 33 terminate in strips 37 made from a non-skid, non-abrasive, resilient material, such as plastic or rubber.

The channel member top 31 and bottom 32 are attached to the channel member front 34 by means of external brackets or bands 40. In this embodiment of the invention 1, there are two brackets 40, each extending vertically across the front 34 and horizontally rearward across a portion of the top 31 and bottom 32, and fixedly attached thereto. The portion 41 of each bracket 40 extending across the channel member front 34 has a horizontal hole 42 formed therein, each said hole 42 having a central axis parallel to the plane of the channel member top 31. An elasticized cord 50 with two ends 51, each end 51 terminating in a hook 52, is threaded through the bracket front portion holes 42. The junction 44 of each bracket front portion 41 and the bracket portion 43 extending across the channel member top 31 is vertically raised as much as two inches to provide lateral stops for ladder legs 3 resting against the channel member 30.

In this embodiment of the invention 1, the channel member 30 has a side-to-side length of twenty-seven inches with the brackets 40 being positioned equidistantly nineteen and one-half inches apart. For residential applications the channel member inside depth is preferably six inches and inside height is preferably four inches. Commercial applications usually require an additional inch in height and depth. The channel member 30 is preferable made from perforated aluminum, thereby providing strength and light weight. However, comparable materials, including wood, may be used. The perforations 39 are optional, but are particularly effective when using metallic materials.

In operation, the channel member 30 is fitted horizontally over the gutter 20, with the channel member top and bottom strips 37 engaging the fascia board 13 to which the gutter 20 is attached. The gutter 20 snugly fits within the channel member interior 36. The channel member top 31 rests on the gutter top 21. The strips 37 prevent damage to the fascia 13. A ladder 2 is set at a desired location. The ladder 2 is raised to a position on the wall top 12 just under the gutter 20. The channel member 30 is placed over the gutter 20. Because of the channel member's snug fit over the gutter 20, the channel member 30 will stay in place without further attachment. The ladder 2 is then raised so that the ladder upper legs 3 rest against the channel member 20, typically against the channel member front top 34, 31 between the bracket junctions 43. The cord 50 is then wrapped about the ladder 2, preferably an upper rung 4, and the cord end hooks 52 attached to the gutter 20 on either side of the channel member 30. The engagement of the cord 50 with the ladder 2 prevents the ladder upper portion legs 3 from "bouncing" over the bracket junctions 43 and sliding laterally. This engagement also retards the ladder bottom (not shown) from kicking out.

The present invention 1 is used extensively under the following situations where a gutter 20 is present: (i) when ladder staging is required for reroofing, dormer accessibility, skylight accessibility, roof repairs; (ii) general roof access for painting, siding, and the like; (iii) extended ladder stay at one point; (iv) heavy load required on ladder; (v) any need to access a non-walk roof; and (vi) numerous round trips on ladder. The present invention permits simplified installation of roofing systems. The inside edges of the upper ladder legs 3 are kept away from sheathing/top of fascia intersection. Drip edge flashing and roofing material can be applied and remain undamaged.

It is understood that the above-described embodiment is merely illustrative of the application. Other embodiments may be readily devised by those skilled in the art which will embody the principles of the invention and fall within the spirit and scope thereof.

I claim:

1. An apparatus for protecting a rain gutter having a top, a bottom, a rear, a front, and two sides, said gutter sides defining a longitudinal axis which lies in a horizontal plane, said rain gutter rear abutting a fascia board, said gutter being attached to said fascia board, comprising:

a horizontal, U-shaped channel member comprised of:

a flat top having a rear edge terminating in a strip of non-skid, non-abrasive, resilient material;

a flat bottom having a rear edge terminating in a strip of non-skid, non-abrasive, resilient material;

an open rear;

a closed, flat front connected to said top and said bottom;

and two open sides, said channel member sides defining a longitudinal axis in a horizontal plane;

a channel member interior defined by said channel member's front, top and bottom;

a plurality of brackets, each said bracket being attached to said channel member front, top and bottom, each said bracket having a portion extending across the channel member front, each said front, bracket portion having a horizontal hole formed therein, each said hole having a central axis parallel to the plane of the channel member top;

a cord with two ends, each end terminating in a hook, said cord being threaded through the bracket front portion holes.

2. An apparatus as recited in claim 1, wherein:

said channel member is adapted to fit horizontally over said gutter, with the channel member top and bottom strips engaging the fascia board to which the gutter is attached, said gutter fitting snugly within the channel member interior, said channel member top resting on the gutter top.

3. An apparatus as recited in claim 2, wherein:

the channel member's top and bottom lie in planes perpendicular to the channel member's front.

4. An apparatus as recited in claim 3, wherein:

the plurality of brackets is comprised of two, brackets, each extending vertically across the channel member front and horizontally rearward across a portion of the top and a portion of the bottom, said brackets being fixedly attached thereto, said brackets being positioned equidistantly apart, said brackets each having a junction between the bracket channel member front portion and the bracket portion extending across the channel member top.

5. An apparatus as recited in claim 4, wherein:

the junction of each bracket front portion and top portion is vertically raised, said junctions adapted to provide lateral stops for a ladder resting against the channel member.

6. An apparatus as recited in claim 5, wherein:

said cord is adapted to be wrapped about said ladder and said cord end hooks attached to the gutter on both sides of the channel member.

7. An apparatus as recited in claim 6, wherein:

said channel member top, bottom and front are perforated.

8. An apparatus as recited in claim 7, wherein:

said channel member is constructed from aluminum.

9. An apparatus as recited in claim 8, wherein:

said cord is elasticized.

* * * * *